US011499355B2

(12) United States Patent
Sobolewski et al.

(10) Patent No.: US 11,499,355 B2
(45) **Date of Patent: *Nov. 15, 2022**

(54) ITEM OF FURNITURE HAVING AN ATTACHABLE PLATE-SHAPED COMPOSITE ELEMENT WITH INTEGRATED FITTING

(71) Applicant: AMBIGENCE GMBH & CO. KG, Herford (DE)

(72) Inventors: Uwe Sobolewski, Bünde (DE); Norbert Poppenborg, Bad Salzuflen (DE); Stefan Andschus, Lübbecke (DE); Michael Tasche, Bielefeld (DE); Gerhard Götz, Bünde (DE)

(73) Assignee: AMBIGENCE GMBH & CO. KG, Herford (DE)

( * ) Notice: Subject to any disclaimer, the term of this patent is extended or adjusted under 35 U.S.C. 154(b) by 445 days.

This patent is subject to a terminal disclaimer.

(21) Appl. No.: 16/489,169

(22) PCT Filed: Feb. 23, 2018

(86) PCT No.: PCT/EP2018/054532

§ 371 (c)(1),
(2) Date: Aug. 27, 2019

(87) PCT Pub. No.: WO2018/158154

PCT Pub. Date: Sep. 7, 2018

(65) Prior Publication Data

US 2019/0383079 A1 Dec. 19, 2019

(30) Foreign Application Priority Data

Feb. 28, 2017 (DE) ..... 10 2017 104 182.6

(51) Int. Cl.
*E05D 15/46* (2006.01)
*A47B 77/00* (2006.01)
(Continued)

(52) U.S. Cl.
CPC ..... *E05D 15/463* (2013.01); *A47B 77/00* (2013.01); *A47B 55/04* (2013.01); *A47B 96/205* (2013.01);
(Continued)

(58) Field of Classification Search
CPC ..... E05D 15/463; A47B 77/00; A47B 55/04; A47B 96/205; E05F 1/12; E05Y 2600/452; E05Y 2900/20
(Continued)

(56) References Cited

U.S. PATENT DOCUMENTS 6,471,312 B1 * 10/2002 Coffey ..... E05F 5/10 312/319.2
2019/0166992 A1 6/2019 Held
(Continued)

FOREIGN PATENT DOCUMENTS

DE 1559963 A1 12/1969
DE 1654589 A1 2/1971
(Continued)

OTHER PUBLICATIONS

Office Action dated Feb. 8, 2021 in related/corresponding EP Application No. 18 708 375.3.
(Continued)

*Primary Examiner* — Daniel J Troy
*Assistant Examiner* — Timothy M Ayres
(74) *Attorney, Agent, or Firm* — Patent Portfolio Builders PLLC

(57) ABSTRACT

An item of furniture includes at least one furniture element and at least one fitting for guiding a movable furniture part. The fitting is integrated into a plate-shaped composite element that is mounted parallel to a wall of the at least one furniture element and is mounted inside the furniture element.

18 Claims, 9 Drawing Sheets

Figure 1A:
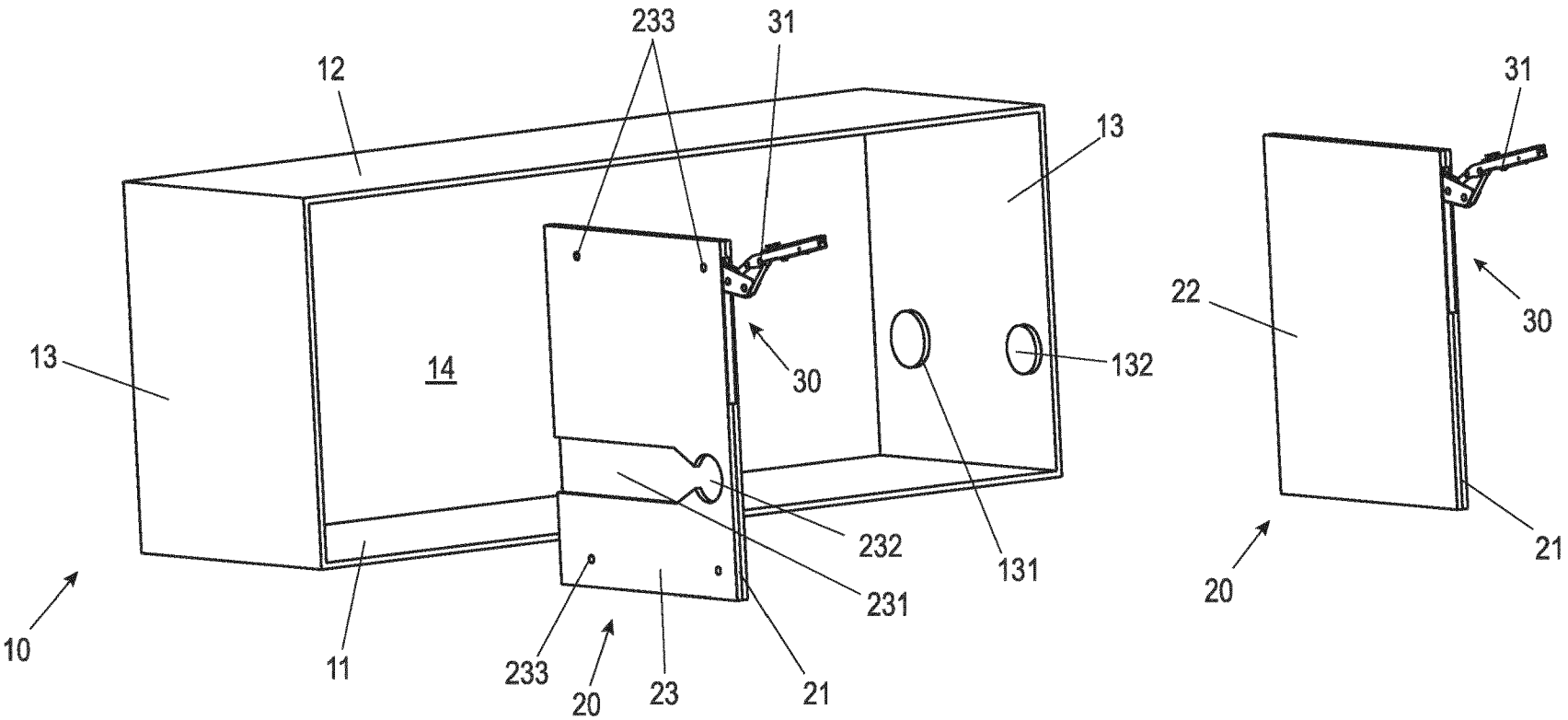

(51) Int. Cl.

| | |
|---|---|
| *A47B 55/04* | (2006.01) |
| *A47B 96/20* | (2006.01) |
| *E05F 1/12* | (2006.01) |

(52) U.S. Cl.
CPC ..... *E05F 1/12* (2013.01); *E05Y 2600/452* (2013.01); *E05Y 2900/20* (2013.01)

(58) Field of Classification Search
USPC ..... 49/205
See application file for complete search history.

(56) References Cited

U.S. PATENT DOCUMENTS

| | | | | |
|---|---|---|---|---|
| 2019/0380495 | A1* | 12/2019 | Sobolewski | A47B 96/205 |
| 2019/0380496 | A1* | 12/2019 | Poppenborg | A47B 96/206 |
| 2020/0008578 | A1* | 1/2020 | Sobolewski | E05D 3/06 |
| 2020/0008579 | A1* | 1/2020 | Sobolewski | E05D 3/06 |
| 2020/0060422 | A1* | 2/2020 | Sobolewski | E05F 1/1041 |

FOREIGN PATENT DOCUMENTS

| | | | | |
|---|---|---|---|---|
| EP | 1217159 | A2 | 6/2002 | |
| EP | 2865832 | A1 | 4/2015 | |
| FR | 1347545 | A | 12/1963 | |
| GB | 1090781 | A | 11/1967 | |
| GB | 1187039 | A | 4/1970 | |
| WO | 2009079671 | A1 | 7/2009 | |
| WO | 2010130570 | A1 | 11/2010 | |
| WO | 2017029199 | A1 | 2/2017 | |
| WO | WO-2018158155 | A1 * | 9/2018 | A47B 77/00 |

OTHER PUBLICATIONS

Office Action in corresponding/related European Application No. EP 18 708 375.3 dated Jul. 27, 2020.
Office Action dated Jun. 15, 2021 in related/corresponding CN Application No. 201880014685.1.
International Search Report dated Apr. 17, 2018 in related/corresponding International Application No. PCT/EP2018/054532.
Written Opinion dated Apr. 17, 2018 in related/corresponding International Application No. PCT/EP2018/054532.

* cited by examiner

ITEM OF FURNITURE HAVING AN ATTACHABLE PLATE-SHAPED COMPOSITE ELEMENT WITH INTEGRATED FITTING

BACKGROUND AND SUMMARY OF THE INVENTION

Exemplary embodiments of the invention relate to an item of furniture having at least one furniture body and at least one fitting for guiding a movable furniture part.

Pieces of furniture, in particular kitchen furniture such as bottom, top, or hanging cabinets, generally have a furniture body open toward the front, on which furniture parts movably guided via one or more fittings are installed. The movably guided furniture parts can be, for example, drawers having a drawer front panel or doors or flaps, which can be used individually or in different combinations in an item of furniture. The present application relates in particular to furniture having fittings that guide doors or flaps as movable furniture parts. Doors and flaps can be in one piece or can consist of multiple individual elements in this case, for example, a folding flap in which various parts of the flap move in relation to one another in the movement sequence.

Door hinges, which are arranged on the side of the pivot axis between furniture body and door, are generally used for guiding doors. A comparable arrangement of hinges can also be used in principle in the case of flaps. These hinges are then arranged along an upper side edge of the flap. However, it is frequently desirable to open the flaps in a combined pivoting and sliding movement, for example, in the case of a hanging cabinet, to obtain the greatest possible access to the cabinet interior without the flap having to be pivoted up in a horizontal position, in which it is reachable not at all or only poorly by the user for closing. For this reason, special flap fittings have become established, which are not arranged along the pivot axis between the furniture body and the flap, but rather laterally on (in general both) side edges between the flap and the side wall of the furniture body.

Such door hinges or flap fittings for installation on an inner side of the side wall or the side walls of the furniture body are known. The fittings unavoidably protrude into the interior of the furniture body in this case, however, which reduces the usable storage space inside the furniture body, on the one hand, and also impairs a subdivision or structuring of the interior of the furniture body, on the other hand.

To install door hinges, milling a pocket into an end face of a side wall, into which the door hinge is insertable from the front, is known. The inner side of the side wall remains free in this manner. A hinge suitable for use in such a milled pocket is known, for example, from the document DE 1559963.

However, this procedure is only suitable for door hinges having a very small installation depth. This is because of the restricted milling depth, with which such a pocket can be milled from the end face into the side wall cost-effectively in the production process. The installation thickness of the door hinge inserted into such a milled pocket is also very limited, since side walls in the furniture field have a wall thickness of only 16-20 mm (millimeters). During the milling procedure, a certain minimum wall thickness has to remain laterally to the milled-out pockets, since an excessively thin wall would already crack or break in the milling procedure or would become so deformed that it no longer has a perfect surface.

The use of larger and more complex door hinges is already not possible in this manner. Flap hinges generally have a large installation depth in the range of more than 10 or 15 cm (centimeters), which is not to be achieved by milling from the end face.

In addition, the milling of a pocket into which the fitting can be inserted presumes a corresponding processing capability of the material of the furniture body and its walls. This is fundamentally provided in the case of wood as the material of the furniture body, for example, at least with sufficient wall thickness. However, if materials that can be processed by cutting less well or not at all are to be used for the furniture body, such pockets cannot be milled in or cannot be milled in cost-effectively. Such materials are, for example, glass, stone, or concrete.

Exemplary embodiments the present invention are directed to an item of furniture of the type mentioned at the outset in which flaps, doors, or other movable furniture parts can be arranged on a furniture body without the fittings used for this purpose obstructing a structuring of the interior of the furniture body and without the material selection for the furniture body being restricted.

An item of furniture according to the invention of the type mentioned at the outset is distinguished in that the fitting is integrated into a plate-shaped composite element, which is arranged inside the furniture body.

The fitting is thus neither attached directly on the furniture body nor is it integrated into a side wall of the furniture body. Instead, the fitting is part of a plate-shaped composite element, which is arranged inside the furniture body. The fitting integrated into the composite element is used to guide a movable furniture part, for example, a door or a flap. The furniture body itself can thus be manufactured independently of the fitting and can also be manufactured from materials that are difficult to process, such as glass or stone, or can be cast in one piece for example, from concrete or another castable material. Because the plate-shaped composite element comprises the fitting in integrated form and the fitting is not attached externally to the plate-shaped composite element, the composite element can in turn have a homogeneous surface. Such a composite element in the furniture body is a visually appealing element which does not impair the interior visually or with respect to the structuring options.

In the scope of the application, the wall of the furniture body on which the composite element is attached can be arranged on any side of the furniture body, independently of its alignment. In particular, the plate-shaped composite element can be arranged in arbitrary alignment inside the furniture body, in particular vertically, horizontally, or obliquely, for example, diagonally in the furniture body.

In one advantageous embodiment of the item of furniture, the plate-shaped composite element has lateral dimensions substantially corresponding to the dimensions of the wall of the furniture body. The composite element thus extends over the entire surface of the corresponding wall of the furniture body. The corresponding inner surface of the furniture body is thus formed over the entire area by the composite element. In spite of the fitting, the item of furniture has a uniform and thus visually appealing interior view.

In a further advantageous embodiment of the item of furniture, the composite element is arranged parallel to a wall of the furniture body. The wall can have any arbitrary alignment in this case, and can be, for example, a side wall or a top panel or bottom panel of the furniture body. In a first embodiment, the composite element abuts the wall of the furniture body. In this case, the composite element appears as part of the wall of the furniture body without impairing the interior. In particular if the composite element is provided with a continuous cover layer facing toward the interior, the arrangement of structuring and/or organization elements in the interior is also not obstructed by a protruding fitting.

In a further advantageous embodiment, the composite element is arranged parallel to one of the walls, but spaced apart from this wall, in the furniture body. The composite element thus provides the fittings required for guiding a door or flap and is simultaneously used in turn as an element for subdividing and thus structuring the interior of the furniture body. It is used in this meaning as an intermediate wall of the furniture body.

If the at least one plate-shaped composite element abuts the wall of the furniture body, it is preferably also connected to the wall, for example, by connecting means such as bolts or the like, which interact with grooves or recesses. Alternatively, or additionally, the plate-shaped composite element can be adhesively bonded to the wall of the furniture body, in particular over the entire area.

In a further advantageous embodiment of the item of furniture, the composite element has at least one core, which is arranged in a plane with the fitting, wherein the at least one core and the fitting are arranged between two continuous cover layers. A composite element constructed in this manner is distinguished by a continuous uniform appearance and haptics of its lateral surface. The core moreover offers a fastening option for the composite element on the furniture body in a simple manner. The core can be manufactured, for example, from wood or a wooden composite material such as MDF (medium-density fiberboard) or HDF (high-density fiberboard). Screws as fastening means can be screwed directly into this material, for example, through corresponding boreholes in the furniture body. Alternatively, inserts, for example, threaded inserts can be arranged in the core, into which the fastening screws can be screwed. To save weight, the core can also comprise a light construction material, for example, paperboard in a honeycomb structure, in portions.

The fitting is advantageously already integrated into the composite element during the assembly thereof. A large fitting having a large installation depth, which even extends, for example, substantially over the entire width of the composite element, can thus also be used. In particular, flap fittings can be used, the lever mechanism of which can be retracted completely (possibly except for installation elements on which the movable furniture part is fastened) into an opening in an end face of the composite element.

The two continuous cover layers are preferably connected in a planar manner to the at least one core and/or the fitting, for example, laminated on. The planar connection stabilizes the composite element and enables the use of relatively thin cover layers having thicknesses in the range of tenths of millimeters.

In a further advantageous embodiment of the item of furniture, at least one further composite element having an integrated fitting is arranged externally on at least one wall of the furniture body. The fitting integrated into the at least one further composite element is preferably positioned on a different side of the furniture body than the fitting integrated into the at least one composite element. In particular, in this case the furniture body has two opposing open sides, wherein the fitting integrated into the at least one further composite element is positioned on one open side of the furniture body, and the fitting integrated into the at least one composite element is positioned on the opposing other side. Thus, for example, a cabinet having an interior can be constructed, which is closed using flaps on opposing sides. Because of the large installation depth of flap fittings, two flap fittings facing toward opposing sides generally cannot be arranged in one plane. The construction having two composite elements, which are arranged on the interior and exterior of a side wall of the furniture body, represents a visually appealing solution.

In a further advantageous embodiment of the item of furniture, an installation element for fastening on a wall is integrated into the at least one composite element. In this embodiment, all functional elements are provided by the composite elements. The furniture body can accordingly be constructed in reduced form. The installation element is preferably fastened on the fitting inside the composite element so that forces which act on the fitting can be dissipated effectively directly via the installation element onto a building wall.

BRIEF DESCRIPTION OF THE DRAWING FIGURES

Figure 1B:
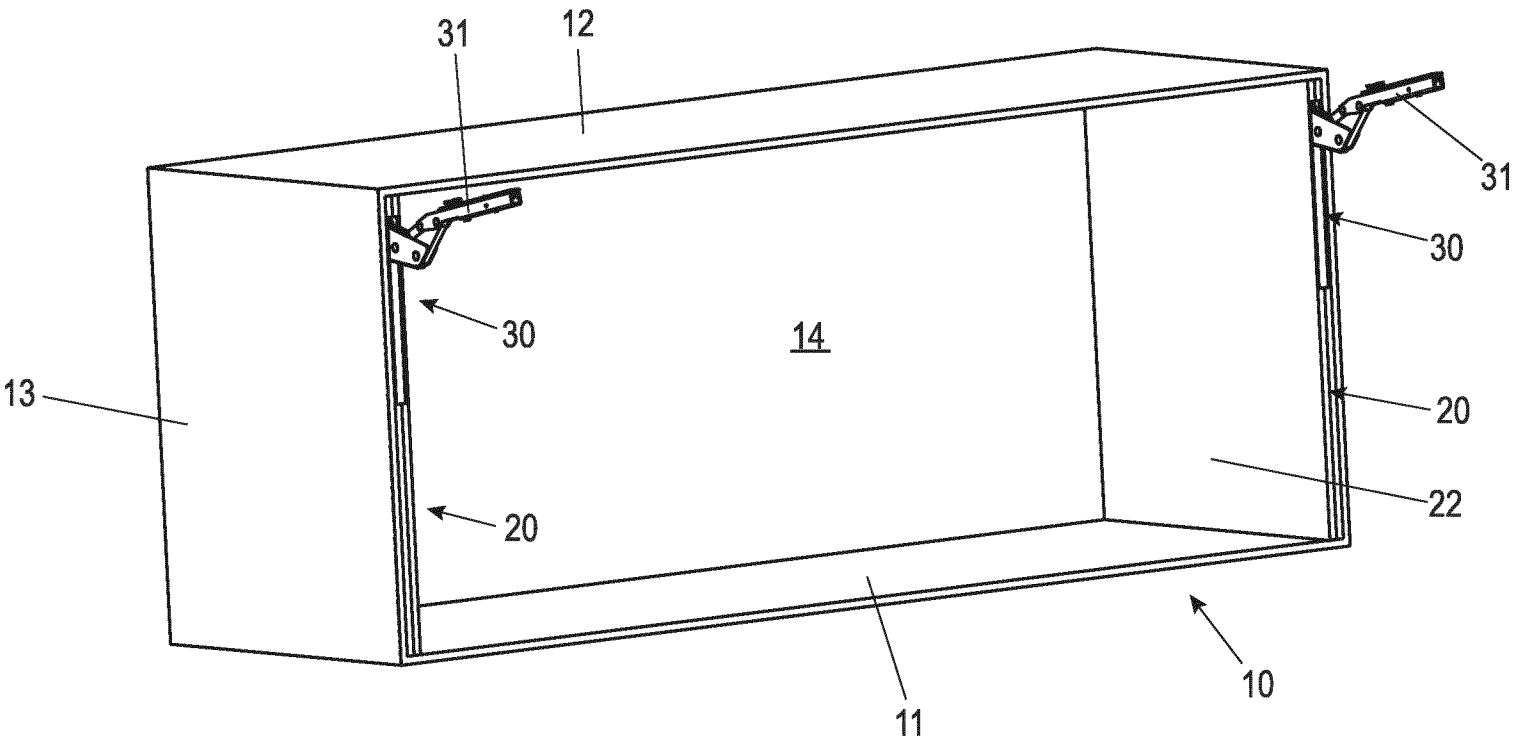
Figure 1C:
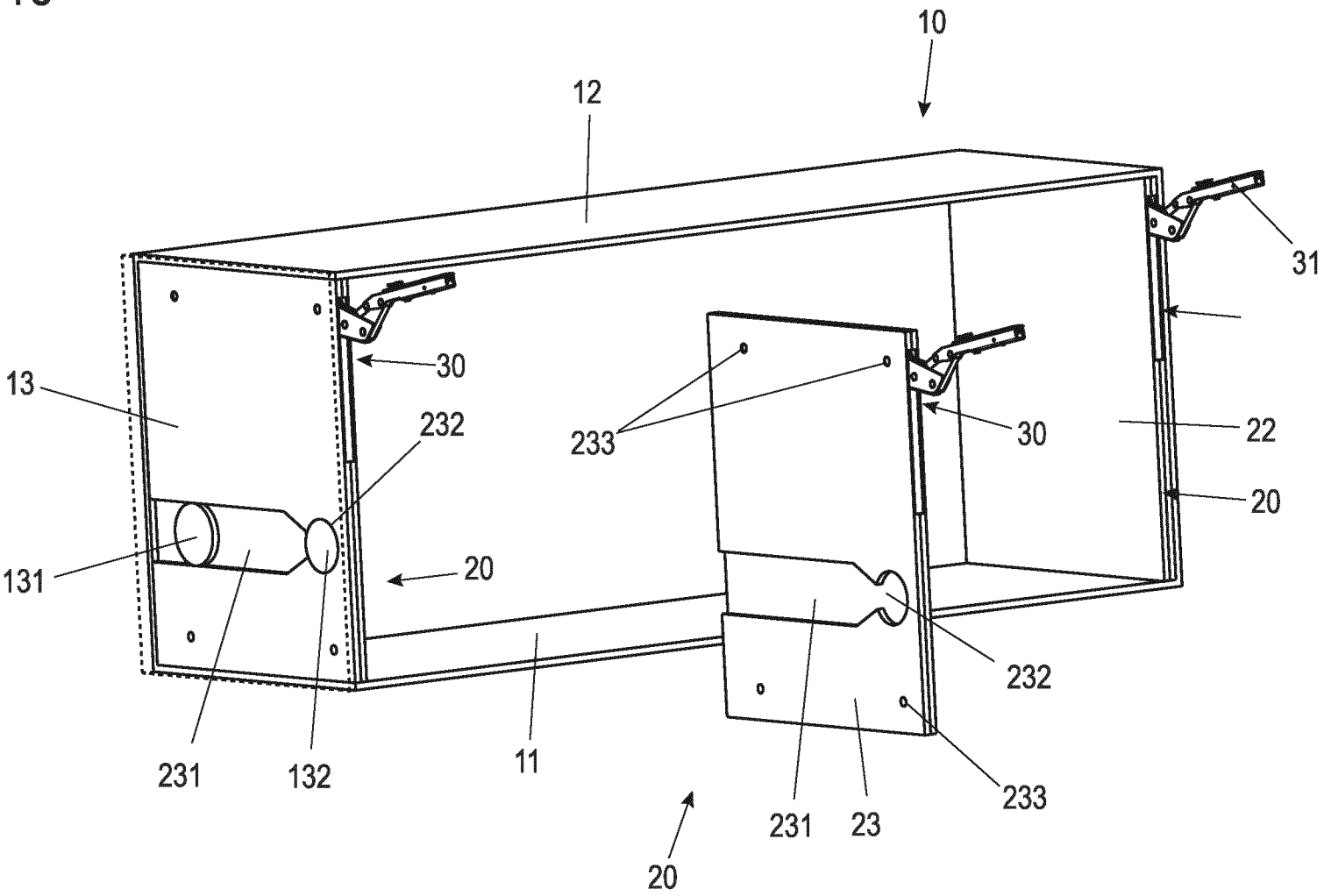
Figure 2:
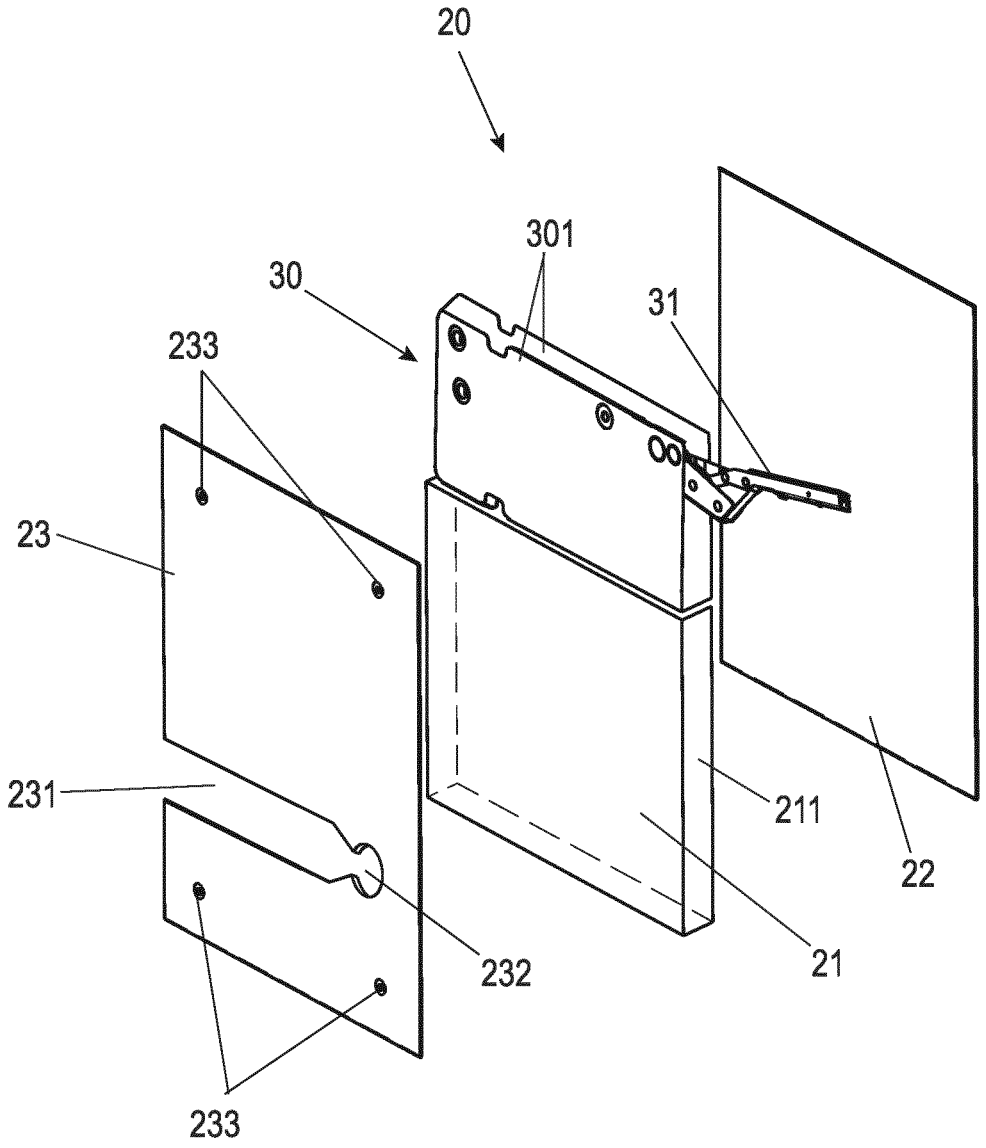
Figure 3A:
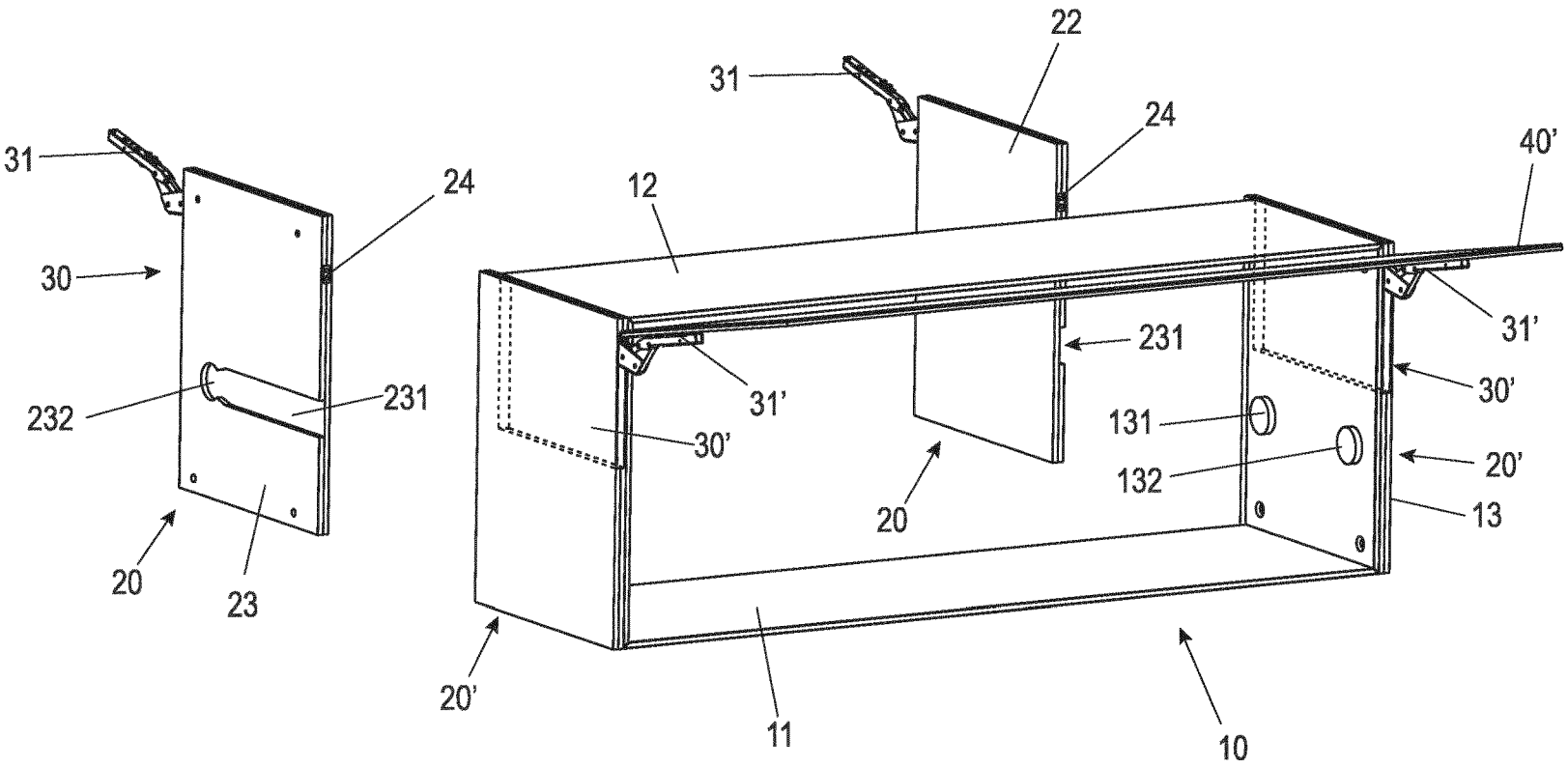
Figure 3B:
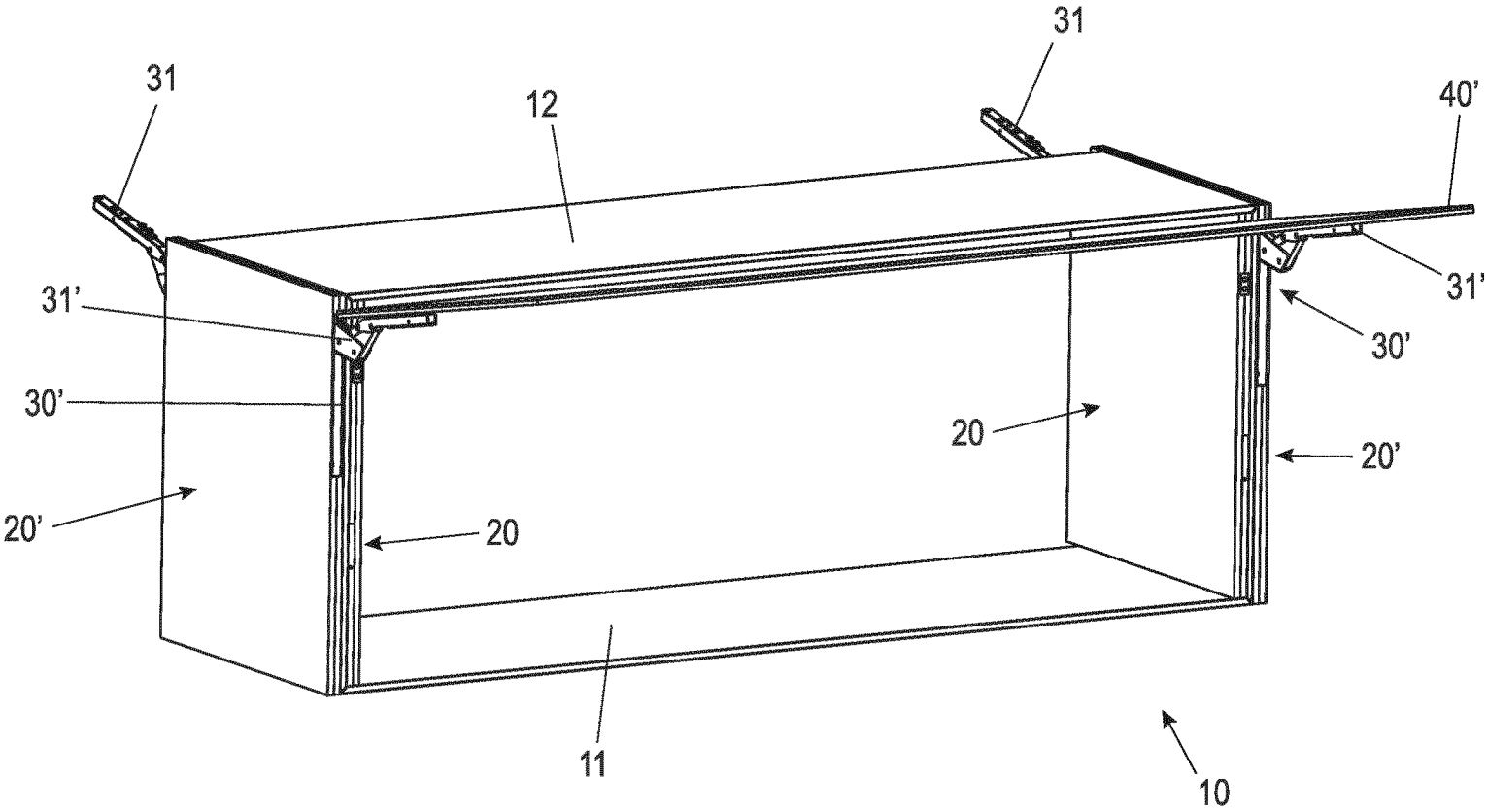
Figure 3C:
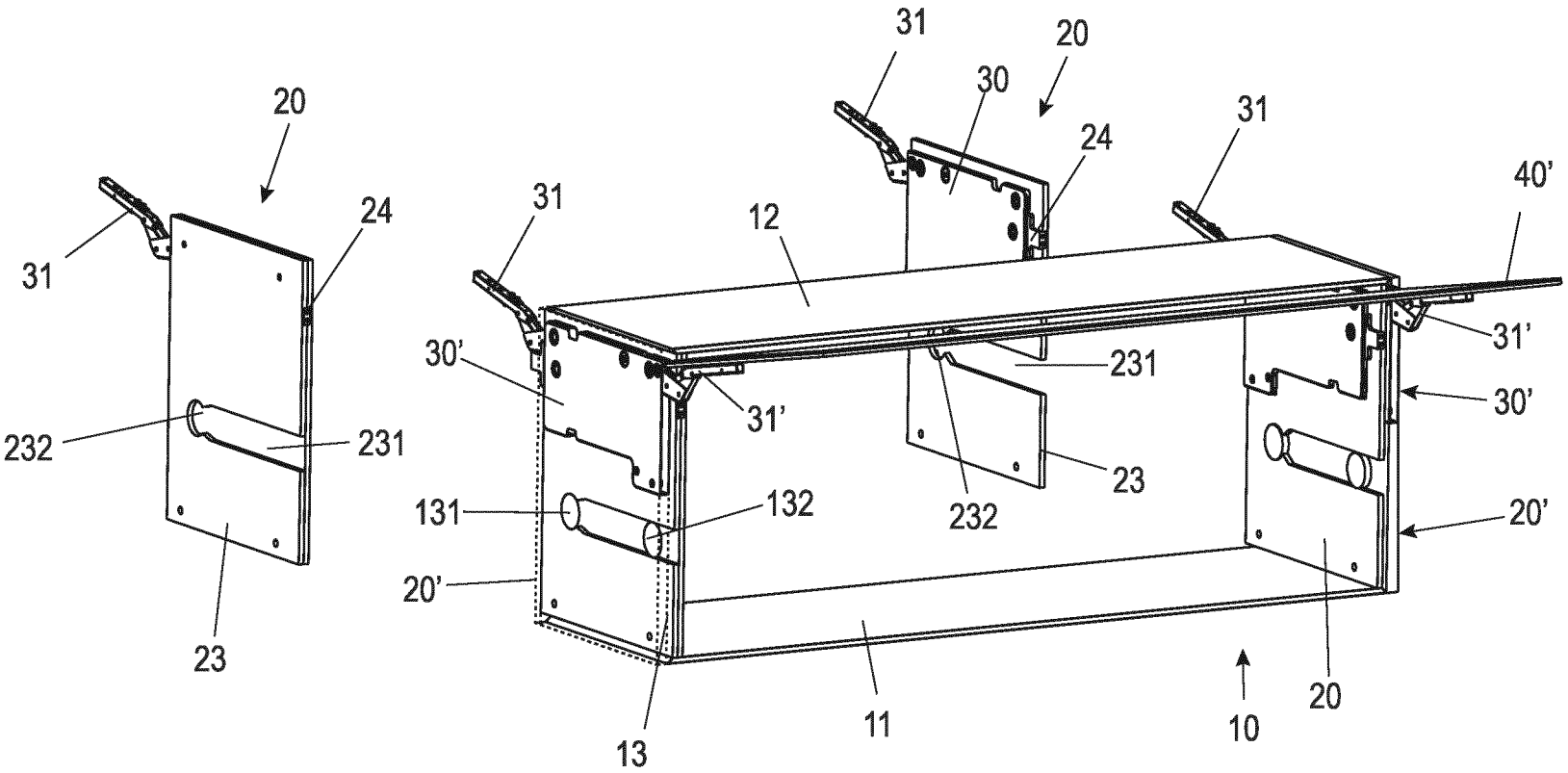
Figure 4:
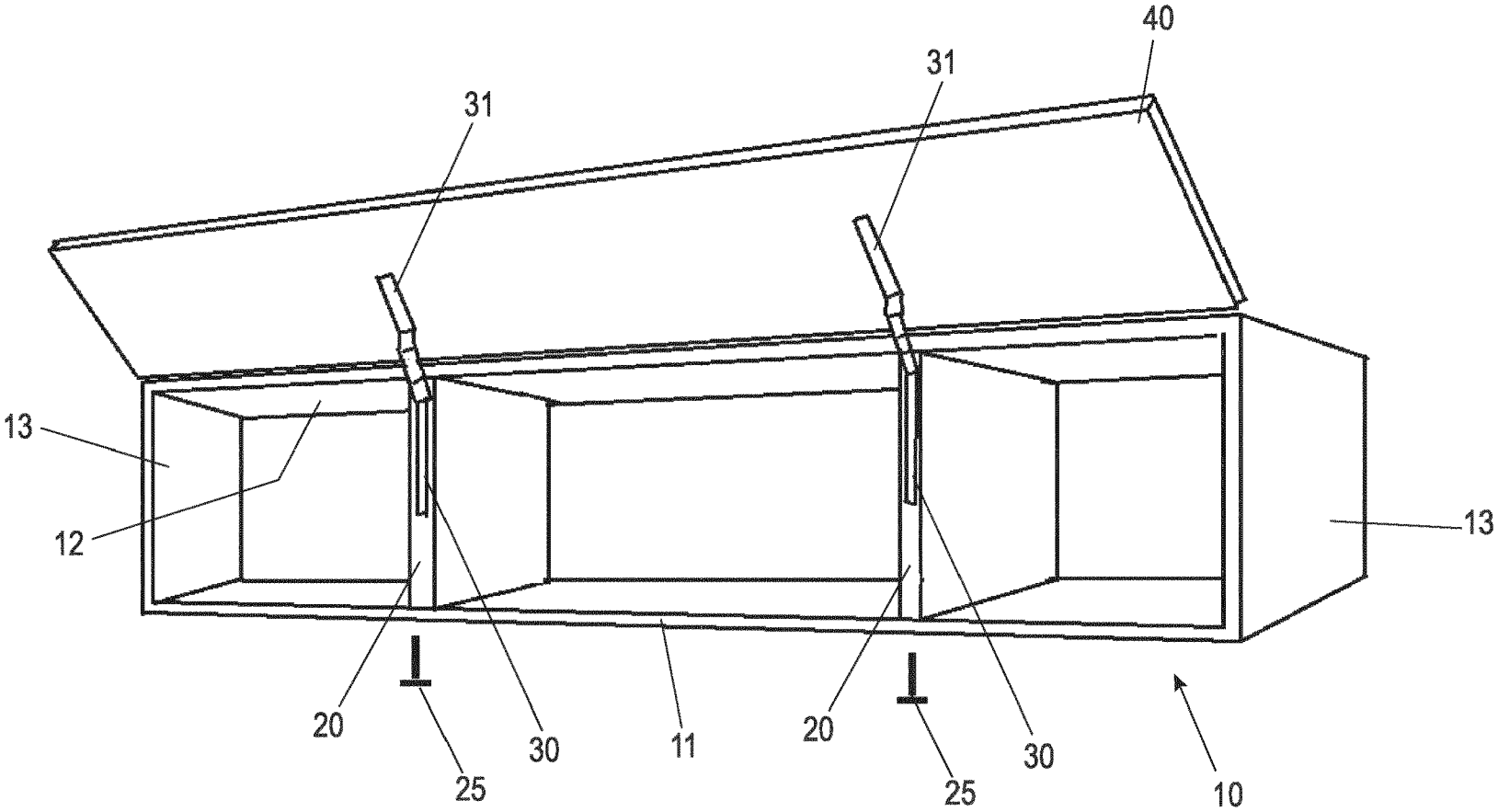
Figure 5:
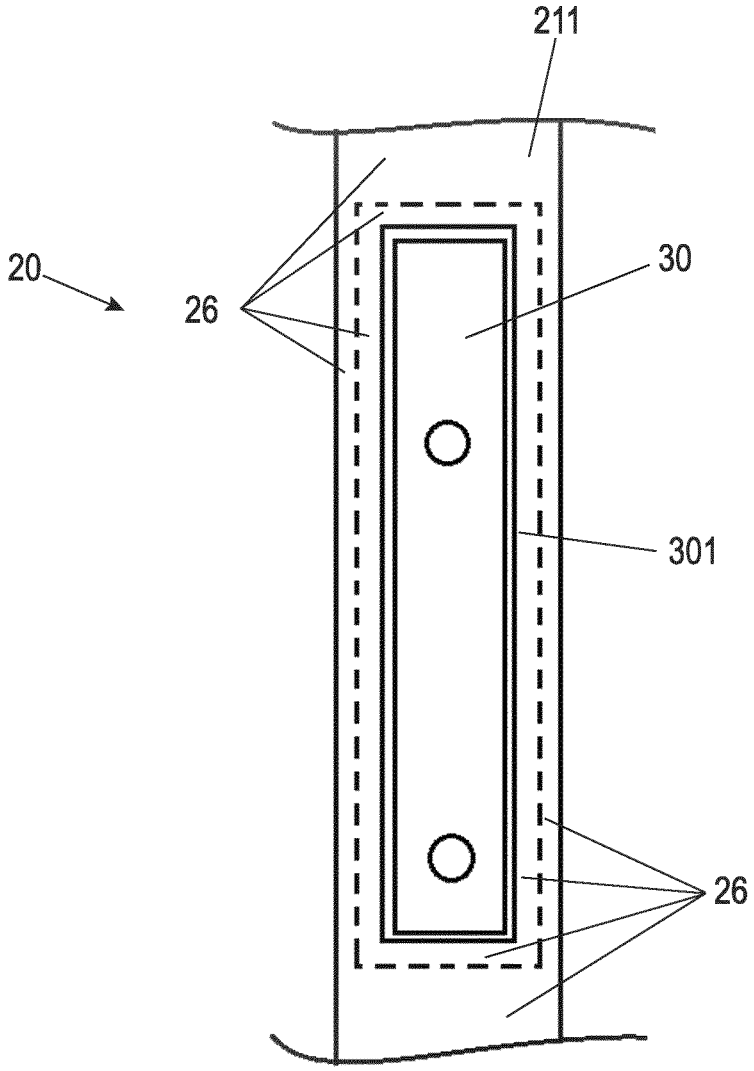

The invention will be explained in greater detail hereafter on the basis of exemplary embodiments with the aid of figures. In the figures:

FIGS. 1*a*-1*c* show various illustrations of a first exemplary embodiment of an item of furniture having a composite element according to a first exemplary embodiment;

FIG. 2 shows an isometric exploded illustration of the composite element according to FIG. 1;

FIGS. 3*a*-3*c* show various illustrations of an item of furniture having a composite element in a second exemplary embodiment;

FIG. 4 shows an isometric illustration of an item of furniture having composite elements in a third exemplary embodiment; and FIG. 5 shows a schematic top view of a front end face of a composite element in the region of an inserted fitting.

DETAILED DESCRIPTION

FIGS. 1*a*-1*c* show various isometric illustrations of a first exemplary embodiment of an item of furniture according to the application having a furniture body 10 and two composite elements 20 here. By way of example, a hanging cabinet of a kitchen is shown as an item of furniture according to the invention.

FIG. 1*a* shows the composite elements 20 separately from the furniture body 10, for example, before the insertion. In FIG. 1*b*, the composite elements 20 are inserted into the furniture body 10. In FIG. 1*c*, finally, one of the composite elements 20 is shown twice, once before the insertion into the furniture body and once inserted into the furniture body, wherein the furniture body 10 is shown partially transparent to illustrate the arrangement of the composite element 20 inside the furniture body 10.

The furniture body 10 of the item of furniture is constructed from a bottom panel 11, a top panel 12, and two side walls 13 and an optional rear wall 14. The elements mentioned form a cuboid open to the front. The furniture body 10 can be produced from known furniture plates, for example, solid wood plates, coated fiberboard or chipboard plates, or also light construction plates. Furthermore, materials more difficult to process, such as glass, stone, or metal, can also be used, in particular since the furniture body 10 does not have complex receptacles for fittings. Furthermore, the furniture body 10 can be cast from a castable material, for example, concrete.

In the illustrated item of furniture, a flap (not shown in FIGS. 1*a*-1*c*) is provided to be able to close the front opening of the furniture body 10. The flap is guided by two fittings 30, which are each integrated into one composite element 20 according to the application. The two composite elements 20 each abut one of the side walls 13 of the furniture body 10 on the inside.

The furniture body 10 is supplemented with the fittings 30 by the composite elements 20 without the fittings 30 being screwed directly onto a wall of the furniture body, for example, the side wall 13. The composite element 20 is dimensioned in this case so that it covers the entire inner side of the side wall 13 of the furniture body 10. A uniform, continuously homogeneous impression of the interior of the furniture body 10 results, since it only has continuous smooth surfaces.

To fasten the composite elements 20 on the respective side wall 13, interlocking connecting means are arranged on the side wall 13 and/or a side of the composite element 20 facing outward. In the present example, these are two disk-like bolts 131 and 132 on the side wall 13 and a groove 231 and a recess 232 on the composite element 20. Further optional connecting elements are indicated in the form of boreholes 233 on the composite element 20.

As the composite element 20 is inserted along the inner wall 13, the bolts 131, 132 engage in the groove 231 or the catch recess 232, respectively. The groove 231 and the recess 232 can be formed undercut so that the composite element 20 is held on the side wall 13. As the composite element 20 is inserted, the bolt 131 is positioned in the rear part of the groove 231 and the bolt 132 locks in the recess 232. The locking is achieved by the natural elasticity of the material, for example, plastic, of the bolt 232 and/or by the elasticity of the transition region between the groove 231 and the recess 232.

Wall fastening means, using which the furniture can be hung on a building wall, are preferably provided on a rear end face of the composite element 20. The force conditions then existing prevent the composite elements 20 from being able to be drawn forward out of the furniture body 10.

It is to be noted that an adhesive bond between the composite elements 20 and the side parts 13 can be used alternatively or additionally to the types of connection shown.

FIG. 2 shows an isometric exploded view of a possible construction of such a composite element 20 and also illustrates its production.

The composite element 20 comprises a core 21, for example, manufactured from a chipboard plate or a medium-density fiberboard (MDF) or high-density fiberboard (HDF). The fitting 30 is preferably arranged in the same plane as the core 21 and preferably having equal thickness, in such a manner that the core 21 and the fitting 30 supplement one another in shape and size so that they together substantially have the dimensions of the composite element 20. In the illustrated example, the core 21 is in one piece and only abuts below the fitting 30. It can alternatively be provided that a further core element is also arranged on other sides of the fitting 30, in particular on its top side. The core 21 can also be formed C-shaped and can adjoin the fitting 30 on three sides, i.e., all sides except the front side.

The core 21 and the fitting 30 can be connected to one another via connecting elements (not shown here), for example, screws, clamps, pins, crimps, or the like. An adhesive bond can also be provided in addition to the mentioned connecting elements or as the only connection.

Cover layers 22, 23 are applied from each side, in particular adhesively bonded (glued) or laminated, onto the arrangement made of the core 21 and the fitting 30 possibly connected thereto. The fitting 30 is selected in this case with respect to its material and the material thickness, for example, of the side plates of the fitting 30 so that it is also not pressed in during a lamination process, which could result in an irregularity of the surface of the cover layers 22, 23. Smaller irregularities in the side plates of the fitting 30 are equalized by the cover layers 22, 23. Such smaller irregularities can originate, for example, due to the bearing points of bolts used for the pivotable mounting of the lever mechanism 31 in the fitting 30.

The production method of the composite element 20 symbolized in FIG. 2, in which the core 21 and the fitting 30 are first aligned matching with one another and possibly connected to one another and then assembled with the cover layers 22, 23 to form the composite element 20, enables the use of a fitting 30 which as shown, for example, extends over the entire width of the composite element 20. In this manner, larger and more complex fittings 30 can be used in the composite element 20 than would be possible in a pocket milled out on the end face of a side wall.

Alternative production methods can be used for producing a suitable composite element 20. For example, it is conceivable to use a centrally divided core 21 for the composite element 20, which is divided in a center plane of the composite element 20 parallel to the cover layers 22, 23. A recess is introduced, for example, milled out, into each half of the core 21 before the assembly. The recesses of the two core halves then enclose an inserted fitting 30 from both sides.

A composite element 20 thus produced can be cut to length in the region of the core, so that the composite element 20 is adaptable to the internal dimensions of the furniture body 10.

In the composite element 20 of FIGS. 1*a*-1*c* and FIG. 2, the cover layer 22 is continuous, so that a uniform and smooth surface is formed toward the interior of the furniture body 10. The connecting means to the furniture body are arranged on the opposing cover layer 23, which abuts the side walls 13 in the item of furniture of FIGS. 1*a*-1*c*. In the present case, the cover layer 23 is cut out to form the groove 231 and the recess 232, into which the groove 231 merges. It can additionally be provided that the groove 231 and/or the recess 232 are restricted in the depth thereof not only to the cover layer 23 but rather also extend deeper up into the core 21. Moreover, the boreholes 233 are introduced, which can optionally also extend up into the core 21. Only boreholes 233 can also be provided for the fastening.

A further exemplary embodiment of an item of furniture having a furniture body 10 and composite elements 20 is illustrated in FIGS. 3*a*-3*c*. FIG. 3*a* again shows the item of furniture before the insertion of the composite elements 20, FIG. 3*b* shows the item of furniture having furniture body 10 and inserted composite elements 20, and FIG. 3*c* shows the composite elements 20, partially in incomplete form, before the insertion into the furniture body 10 and in the double already inserted into the furniture body 10. Moreover, one of the side walls 13 is shown partially transparent of the furniture body 10 in FIG. 3*c*, to be able to better see the arrangement of the composite element 20 inside the furniture body 10. Identical reference signs in these figures identify identical or identically-acting elements as in the above-described figures.

In contrast to the exemplary embodiment of FIGS. 1*a*-1*c*, in the present case, the item of furniture is a cabinet element which is accessible from two sides.

In FIGS. 3*a*-3*c*, the item of furniture is shown from a rear side. In contrast to the example of FIGS. 1*a*-1*c*, the item of furniture does not have a rear wall 14 but rather is open from the rear side toward the interior. This rear side is closable by a flap 40', which is guided on the fitting 30' by a lever mechanism 31', which fittings are integrated in the present case into composite elements 20'. These composite elements 20' are externally placed on the side walls 13 of the furniture body 10 and fastened on the side wall 13. In the illustrated example, this is achieved via screws, which are screwed through boreholes 133 in the side walls 13 into the externally placed composite element 20'. Alternatively, other connecting means can be used, for example, tongue-and-groove or bolts, for example, as shown in conjunction with the composite element 20 used on the inside.

After this has been carried out—as in the example of FIGS. 1*a*-1*c*—the composite elements 20 are inserted into the furniture body 10 and fastened therein by the interaction of the bolts 131, 132 and the groove 231 or the recess 232, respectively. In contrast to the exemplary embodiment of FIGS. 1*a*-1*c*, the two bolts 131, 132 only have one equal diameter here and not different diameters, as in the first exemplary embodiment.

An installation element 24 can be seen well in FIG. 3*c* in the composite element 20, which is shown incompletely without core 21 and without cover layer 22. This installation element 24 can be used for the wall installation in the case of a furniture body 10, the interior of which is only accessible on one side (for example, the furniture body 10 according to FIGS. 1*a* to 1*c*). The installation element 24 is preferably (also) fastened on the fitting 30, so that forces which act on the fitting 30 can be dissipated effectively directly via the installation element 24 onto the building wall.

In the exemplary embodiment of FIGS. 3*a*-3*c*, composite elements 20' are arranged externally and composite elements 20 are arranged internally on the furniture body 10. The composite elements 20, 20' can also both be arranged on the inside of the furniture body 10. In this case, for example, composite elements 20 are arranged on the side walls 13 and composite elements 20' are arranged on the composite elements 20.

FIG. 4 shows a further exemplary embodiment of an item of furniture having a cuboid furniture body 10, in which two composite elements 20 having integrated fitting 30 are also provided. The fittings 30 support a flap 40, which is explicitly shown here, via the lever mechanism 31 thereof.

In both above-described exemplary embodiments, the composite elements 20 according to the application are fastened on side walls 13 of the furniture body 10. In contrast thereto, in the exemplary embodiment of FIG. 4, the composite elements 20 are also arranged parallel to the side walls 13 but spaced apart therefrom. They thus form vertical intermediate walls for the furniture body 10. By way of the two composite elements 20 having the integrated fitting 30, on the one hand, the fittings required for guiding the flap 40 are provided for the furniture body 10 and at the same time its interior is structured, divided into three compartments by way of example here.

The composite elements 20 can be fastened, for example, by screws 25, which are screwed into the composite elements 20 on the end faces through the bottom panel 11 and the top panel 12. The side wall may also be fastened in the body using typical furniture connecting methods, for example, lenticular springs or dowels. Fastening elements which are fixed beforehand in the furniture body (T-shape) and on to which the side wall can subsequently be pushed, would also be conceivable.

FIG. 4 shows a furniture body to be open on one side. If the furniture body 10 is to be open from both sides similarly as in FIGS. 3*a*-3*c*, the exemplary embodiment of FIG. 4 can be expanded with further composite elements 20, which are arranged in the other opening direction on the side wall 13. By way of the arrangement of the composite elements 20 as intermediate walls and on a side wall, an opening can be implemented in both directions, which appears particularly narrow in appearance, since a composite made of multiple composite elements 20 is not required.

FIG. 5 shows a top view of a front end face 211 of a composite element 20 in the region of the fitting 30. In this exemplary embodiment, an edge band 26 is applied as a narrow side coating on the front end face 211 of the core 21 and thus the front end face of the composite element 20.

The edge band 26 is omitted in the region of the opening of the fitting 30, out of which the lever mechanism 31 (not visible in this illustration) extends, for example. The edge band 26 is applied to the front end face 211 after integration of the fitting 30 into the composite element 20 or also after insertion of the fitting 30 into the composite element 20.

The edge band 26 is cut out so that it rests in portions on the fitting and covers, for example, the edges of the side plates 301 of the fitting 30 or other elements visible outside the opening of the fitting 30. The outlines of the fitting 30 are indicated by dashed lines in FIG. 5. Due to the arrangement of the edge band 26 also on portions of the fitting 30, the fitting 30—except for the extendable lever mechanism 31—is integrated completely into the composite element 20 and is no longer visible on its front side 211.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

10 furniture body
11 bottom panel
12 top panel
13 side wall
131, 132 bolt
14 rear wall
20, 20' composite element
21 core
211 front end face
22, 23 cover layer
231 groove
232 recess
233 borehole
24 installation element
25 screw

26 edge band
30, 30' fitting
301 side plate
31, 31' lever mechanism
40, 40' flap

The invention claimed is:

1. An item of furniture, comprising:

at least one furniture body;

a movable furniture part, which is a flap or flap arrangement;

at least one fitting configured to guide the movable furniture part; and two continuous cover layers, wherein the at least one fitting is a flap fitting, which guides the movable furniture part, and is integrated into at least one plate-shaped composite element that is aligned parallel to a wall of the at least one furniture body and is arranged inside the at least one furniture body, wherein the at least one fitting comprises a lever mechanism, wherein the lever mechanism, except for installation elements on which the moveable furniture part is fastened, is completely retractable into an opening in an end face of the at least one plate-shaped composite element, wherein the at least one composite element comprises at least one core, wherein the two continuous cover layers are connected in a planar manner to the at least one core and/or the at least one fitting, and wherein the two continuous cover layers are laminated in a planar manner onto the at least one core and/or the at least one fitting, and wherein the at least one core and the at least one fitting are arranged between the two continuous cover layers.

2. The item of furniture of claim 1, wherein the at least one plate-shaped composite element has lateral dimensions substantially corresponding to dimensions of the wall inside the at least one furniture body.

3. The item of furniture of claim 1, wherein the wall is a side wall of the furniture body.

4. The item of furniture of claim 1, wherein the at least one plate-shaped composite element is arranged spaced apart from the wall and forms an intermediate wall for at least one the furniture body.

5. The item of furniture of claim 1, wherein the at least one plate-shaped element abuts the wall.

6. The item of furniture of claim 5, wherein the at least one plate-shaped composite element is connected to the wall.

7. The item of furniture of claim 6, wherein the at least one plate-shaped composite element is connected to the wall via interacting bolts and grooves or recesses.

8. The item of furniture of claim 6, wherein the plate-shaped composite element is adhesively bonded to the wall of the at least one furniture body.

9. The item of furniture of claim 1, wherein the at least one core is arranged in a plane with the at least one fitting.

10. The item of furniture of claim 1, wherein at least one further composite element having an integrated fitting is arranged externally on at least one wall of the at least one furniture body.

11. The item of furniture of claim 1, wherein at least one further composite element having an integrated fitting is arranged on the at least one plate-shaped composite element.

12. The item of furniture of claim 1, wherein the composite element is arranged on the inside on at least one wall of the at least furniture body and at least one further composite element having an integrated fitting forms an intermediate wall of the at least one furniture body.

13. The item of furniture of claim 11, wherein the fitting integrated into the at least one further composite element is positioned on a different side of the at least one furniture body than the fitting integrated into the at least one composite element.

14. The item of furniture of claim 13, wherein the at least one furniture body has two opposing open sides, wherein the fitting integrated into the at least one further composite element is positioned on one open side of the furniture body, and the fitting integrated into the at least one composite element is positioned on the opposing other side.

15. The item of furniture of claim 1, wherein an installation element configured to fasten on a building wall is integrated into the at least one plate-shaped composite element.

16. The item of furniture of claim 1, wherein the at least one furniture body is glass, stone, or concrete.

17. The item of furniture of claim 1, wherein the lever mechanism is configured to guide the movable furniture part.

18. The item of furniture of claim 17, wherein the lever mechanism is located completely between the two continuous cover layers in a closed state of the movable furniture part.

* * * * *